US009592950B2

(12) United States Patent
Iwamatsu

(10) Patent No.: US 9,592,950 B2
(45) Date of Patent: Mar. 14, 2017

(54) BOTTLE CONTAINER WITH BOTTLE BREAKAGE-PREVENTING FUNCTION

(71) Applicant: IWATA LABEL CO., LTD., Aichi (JP)

(72) Inventor: Hironori Iwamatsu, Aichi (JP)

(73) Assignee: IWATA LABEL CO., LTD., Aichi (JP)

( * ) Notice: Subject to any disclaimer, the term of this patent is extended or adjusted under 35 U.S.C. 154(b) by 0 days.

(21) Appl. No.: 14/760,811

(22) PCT Filed: Nov. 28, 2013

(86) PCT No.: PCT/JP2013/082023
§ 371 (c)(1),
(2) Date: Jul. 14, 2015

(87) PCT Pub. No.: WO2014/129041
PCT Pub. Date: Aug. 28, 2014

(65) Prior Publication Data

US 2015/0353233 A1 Dec. 10, 2015

(30) Foreign Application Priority Data

Feb. 25, 2013 (JP) ..... 2013-034863

(51) Int. Cl.
*B65D 85/30* (2006.01)
*B65D 81/38* (2006.01)
*B65D 23/08* (2006.01)

(52) U.S. Cl.
CPC ..... *B65D 85/302* (2013.01); *B65D 23/0878* (2013.01); *B65D 23/0885* (2013.01);
(Continued)

(58) Field of Classification Search
CPC ..... B65D 23/0885; B65D 23/0878; B65D 23/0842; B65D 81/3876; B65D 85/30; B65D 85/302; B65D 2501/24312; B65D 23/001
(Continued)

(56) References Cited

U.S. PATENT DOCUMENTS 3,760,968 A * 9/1973 Amberg . ..... B29C 63/426 156/86
4,241,839 A * 12/1980 Alberghini ..... B65D 23/001 215/12.1
(Continued)

FOREIGN PATENT DOCUMENTS

JP H0642668 U 6/1994
JP 2006-131291 A 5/2006
JP 2012-236608 6/2012

OTHER PUBLICATIONS

International Search Report and Written Opinion for PCT/JP2013/082023.
(Continued)

*Primary Examiner* — Jeffrey Allen
*Assistant Examiner* — Jennifer Castriotta
(74) *Attorney, Agent, or Firm* — McClure, Qualey & Rodack, LLP

(57) ABSTRACT

A bottle container includes: a tubular inner container 2 including a cap at an upper portion thereof; and an outer container 3 mounted so as to extend along a trunk 5 and a bottom 6 of the inner container 2, the inner container 2 includes a shoulder 8 at the upper portion which is not covered with the outer container 3, an outer peripheral portion 13*b* of a bottom 13 of the outer container 3 is made thicker than a side wall 14 of the outer container 3, a center portion 13*a* of the bottom 13 of the outer container 3 is made thinner than the outer peripheral portion 13*b* to form a space
(Continued)

13*c*, and the outer container 3 mounted to the inner container 2 and the shoulder 8 of the inner container 2 are covered with a heat-shrinkable film 4.

7 Claims, 17 Drawing Sheets

(52) U.S. Cl.
CPC ..... *B65D 81/3876* (2013.01); *B65D 85/30* (2013.01); *B65D 2501/24312* (2013.01)

(58) Field of Classification Search
USPC ..... 206/497
See application file for complete search history.

(56) References Cited

U.S. PATENT DOCUMENTS

| | | | | | |
|---|---|---|---|---|---|
| 4,880,126 | A * | 11/1989 | Anderson | B65D 23/001 | 206/519 |
| 5,462,180 | A * | 10/1995 | Bright | B29C 47/0023 | 215/12.1 |
| 9,173,814 | B2 | 11/2015 | Jakobsen et al. | | |
| 2005/0115978 | A1* | 6/2005 | de la Guardia | B65D 23/001 | 220/737 |

OTHER PUBLICATIONS

Office Action issued in corresponding China patent application on Jun. 15, 2016.

* cited by examiner

BOTTLE CONTAINER WITH BOTTLE BREAKAGE-PREVENTING FUNCTION

This application is the 35 U.S.C. §371 national stage of PCT application entitled with "Bottle container with bottle breakage-preventing function" having serial number PCT/JP2013/082023, filed on Nov. 28, 2013. This application also claims priority to and benefit of Japanese Application No. 2013-034863, filed on Feb. 25, 2013 which is incorporated by reference in its entity.

FIELD OF THE INVENTION

The invention relates to a bottle container with a bottle breakage-preventing function.

BACKGROUND OF THE INVENTION

A bottle container with a bottle breakage-preventing function is disclosed in Patent Literature 1.

CITATION LIST

Patent Document

Patent Document 1: Japanese Laid-Open Patent Publication No. 2012-236608

SUMMARY OF INVENTION

Problems to be Solved by the Invention

However, since the bottle container covers the bottom of a container with a cushioning member, if impact is applied to the trunk of the bottle container due to drop or the like, bottle breakage may occur.

An object of The invention is to provide a bottle container with a bottle breakage-preventing function of preventing bottle breakage due to impact on the bottom or trunk of the bottle container.

Solution to the Problems

A bottle container with a bottle breakage-preventing function according to The invention includes: a tubular inner container including a cap at an upper portion thereof, the inner container being formed of an easily-breakable material; and an outer container mounted so as to extend along a bottom and a trunk of the inner container. The inner container includes a shoulder formed in a constricted shape or a tapered shape at the upper portion which is not covered with the outer container. An outer peripheral portion of a bottom of the outer container is made thicker than a trunk of the outer container, and a center portion of the bottom of the outer container is made thinner than the outer peripheral portion to form a space such that the center portion of the bottom is not brought into contact with the bottom of the inner container. The outer container mounted to the inner container and at least the shoulder of the inner container are covered with a heat-shrinkable film, whereby the inner container and the outer container are integrated.

According to The invention, since the outer container is mounted so as to extend along the bottom and the trunk of the inner container formed of the easily-breakable material and the inner container and the outer container are integrated by means of the heat-shrinkable film, impact on the bottom or the trunk of the inner container, etc. can be absorbed by the outer container to prevent breakage of the inner container.

DESCRIPTION OF EMBODIMENTS

Figure 1:
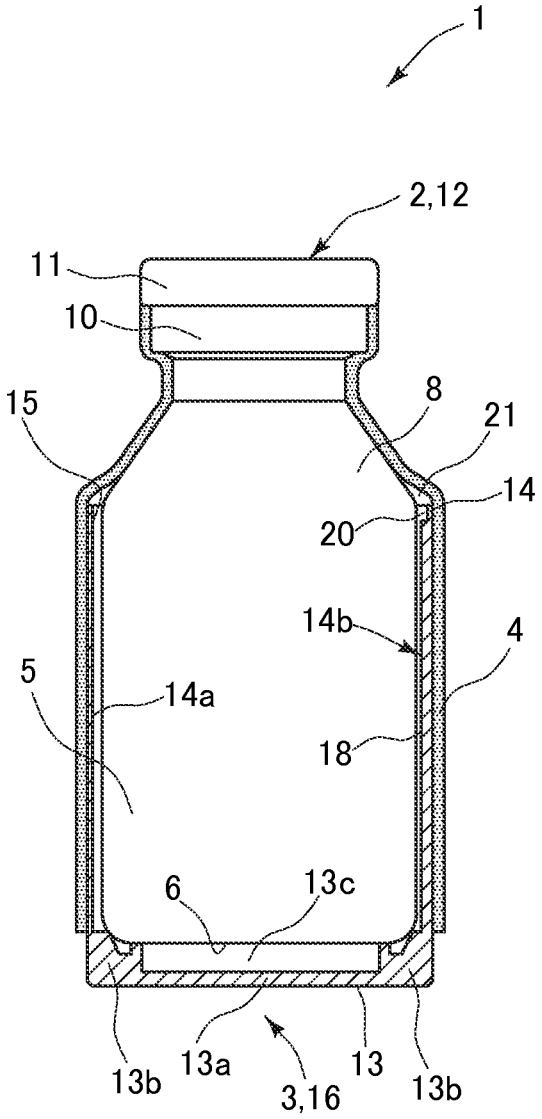
FIG. 1 is a conceptual diagram showing an example of a bottle container of The invention.
Figure 2A:
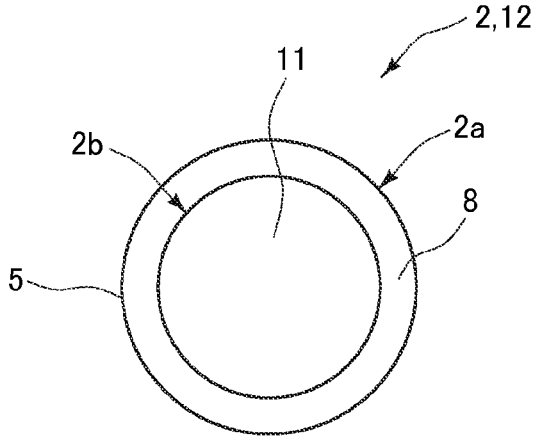
FIG. 2A is a schematic plan view showing a vial constituting a part of the bottle container of FIG. 1.
Figure 2B:
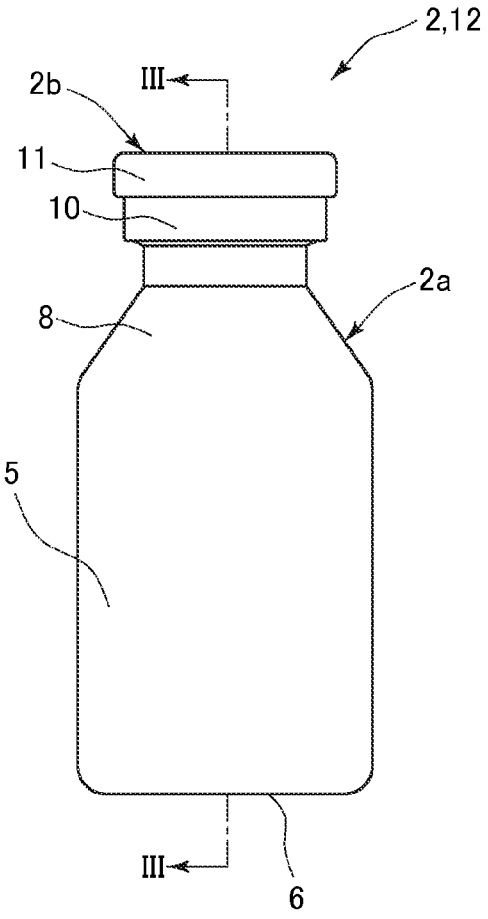
FIG. 2B is a schematic side view of the vial of FIG. 2A.
Figure 3:
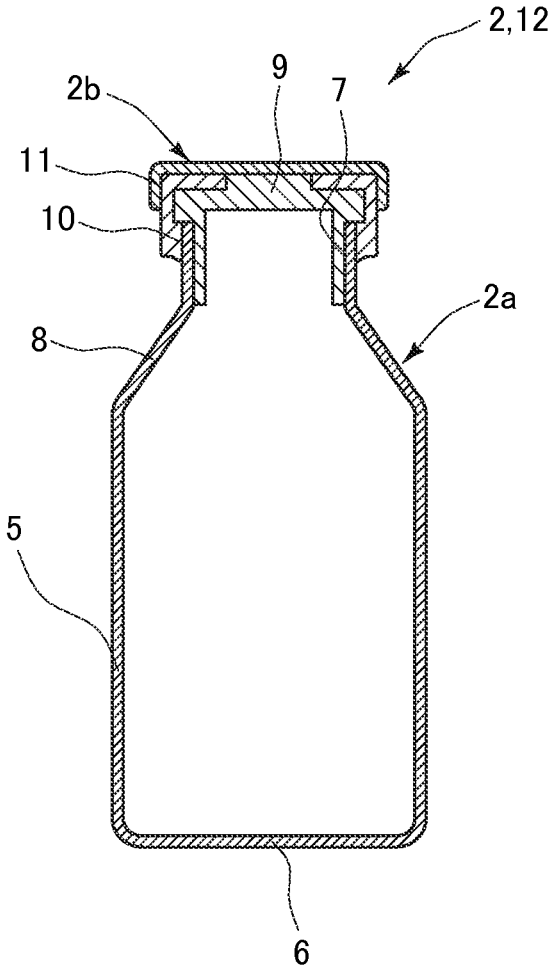
FIG. 3 is a schematic cross-sectional view of the vial of FIG. 2B, taken along the line III-III.

As shown in FIG. 1, a bottle container 1 includes an inner container 2, an outer container 3 which receives the inner container 2 therein, and a heat-shrinkable film 4 which integrates and wraps the inner container 2 and the outer container 3. In FIG. 1, only the inner container 2 is shown in a side view, and the outer container 3 and the heat-shrinkable film 4 are shown in a cross-sectional view. As shown in FIG. 2A and FIG. 2B, the inner container 2 includes an inner container body 2*a* and a cap 2*b*, and the cap 2*b* is located at an upper portion of the inner container body 2*a*. The inner container body 2*a* includes a cylindrical trunk 5 and a bottom 6 which forms a lower end part of the trunk 5. As shown in FIG. 3, an annular opening portion 7 is located at the upper side of the trunk 5, and a shoulder 8 having a tapered shape is formed between the trunk 5 and the opening portion 7. The inner container body 2*a* is formed of an easily-breakable material (bottle) and has a light-transmitting property of being transparent or semitransparent.

As shown in FIG. 3, the cap 2*b* which covers the opening portion 7 of the inner container body 2*a* includes a sealing plug 9, a sealing portion 10, and a cap portion 11. The sealing plug 9 is formed of an elastic body so as to block the opening portion 7 of the inner container body 2*a*, the surrounding of the opening portion 7 plugged with the sealing plug 9 is fixed by the sealing portion 10 which is made of metal, and the cap portion 11 is provided so as to cover the upper surfaces of the sealing plug 9 and the sealing portion 10.

The inner container 2, which includes the cap 2*b* and the inner container body 2*a* having the opening portion 7 blocked by the cap 2*b*, is a medical vial 12 in which the opening portion 7 of the inner container body 2*a* is plugged with the cap 2*b* after a drug solution is injected into the inner container body 2*a*.

As shown in FIG. 4A, FIG. 4B, FIG. 5A, and FIG. 5B, the outer container 3 is a transparent or semitransparent cylindrical cushioning container 16 which includes a bottom 13, a side wall 14, and an opening 15, and the vial 12 is received therein. The cushioning container 16 has a light-transmitting property of being transparent or semitransparent and is formed from a resin.

Figure 5A:
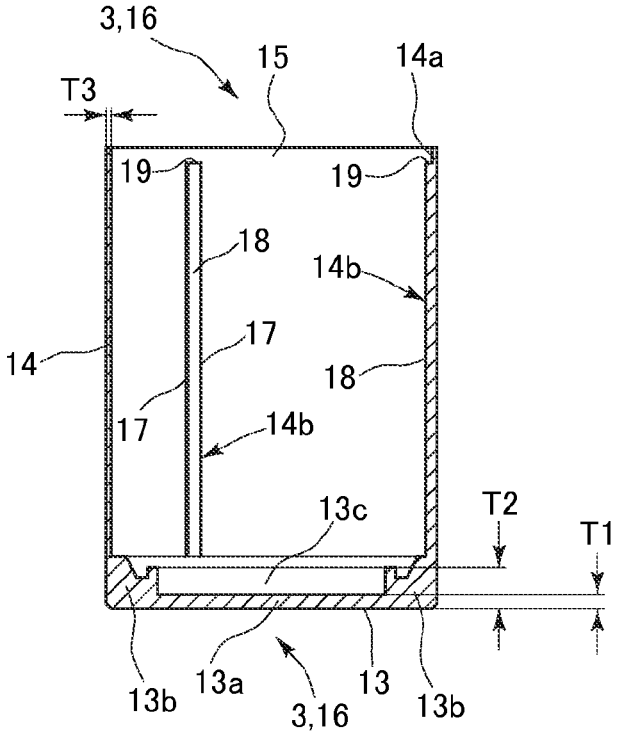
FIG. 5A is a schematic cross-sectional view of the cushioning container of FIG. 4A, taken along the line VA-VA.

As shown in FIG. 5A, the bottom 13 of the cushioning container 16 includes a center portion 13*a* and an outer peripheral portion 13*b*, and the center portion 13*a* is formed with a thickness T1 smaller than the thickness T2 of the outer peripheral portion 13*b* (T1<T2), whereby a space 13*c* is formed.

Figure 5B:
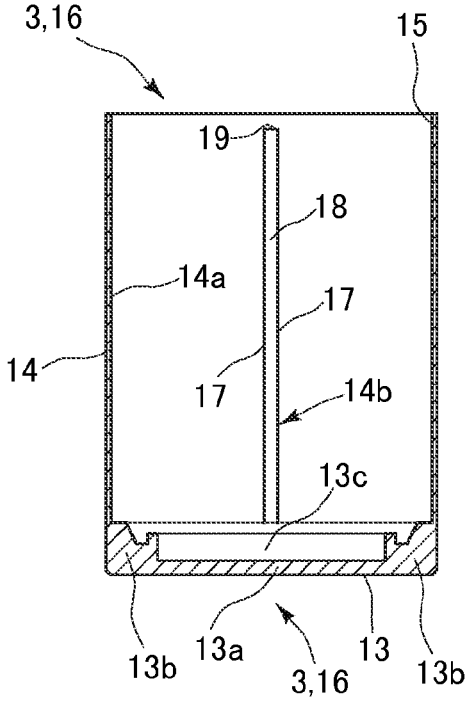
FIG. 5B is a schematic cross-sectional view of the cushioning container of FIG. 4A, taken along the line VB-VB.

As shown in FIG. 5A and FIG. 5B, the side wall 14 includes projection portions 14*b* which project inward and extends from a lower portion of an inner wall 14*a* toward the opening 15, that is, in an up-down direction in the drawing (the height direction of the side wall 14). The side wall 14 is formed in a cylindrical shape. As shown in FIG. 5A, the side wall 14 is formed with a thickness T3 smaller than the thickness T2 of the outer peripheral portion 13*b* of the bottom 13 (T3<T2).

Each projection portion 14*b* extends from the bottom 13 toward the opening 15 to the vicinity of the opening 15 without reaching the opening 15. Specifically, each projection portion 14*b* has a transverse cross-section having a quadrilateral shape with four right angles which is a rectangle or a square, and has outer opposed surfaces 17 opposed to each other (FIG. 4A), a flat connection surface 18 connecting both outer opposed surfaces 17, and a step 19 projecting toward the inner side of the cushioning container 16 at the upper end of the projection portion 14*b*. The outer opposed surfaces 17 are formed such that the interval therebetween is uniform along the longitudinal direction.

Figure 4A:
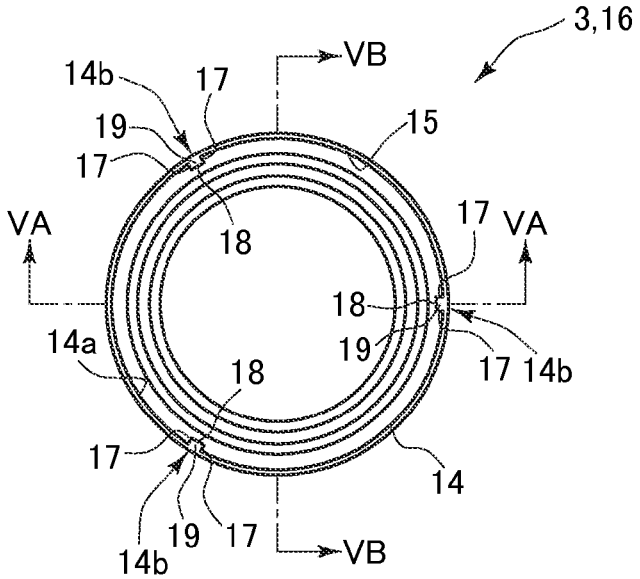
FIG. 4A is a schematic plan view showing a cushioning container constituting a part of the bottle container of FIG. 1.
Figure 4B:
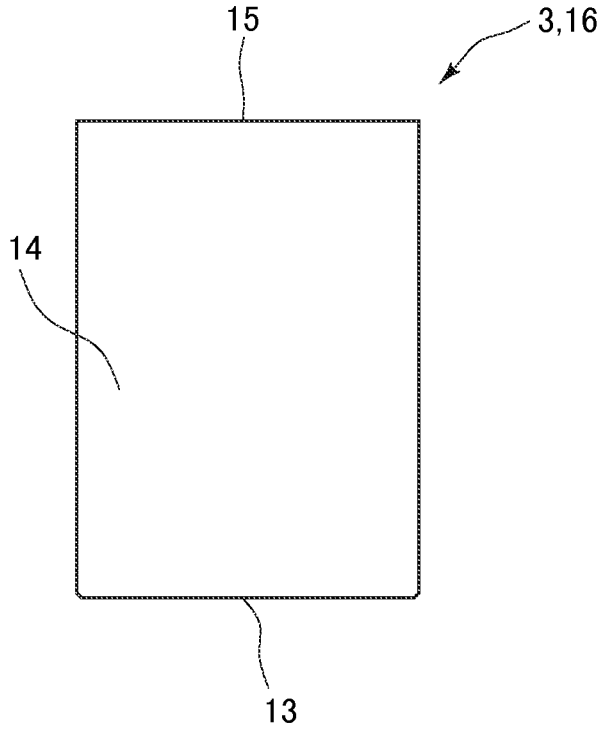
FIG. 4B is a schematic side view of FIG. 4A.

In addition, as shown in FIG. 4A, the projection portions 14*b* are formed on the inner wall 14*a* of the cushioning container 16, which is formed in a circular shape as seen from above, discontinuously in the circumferential direction. Specifically, the projection portions 14*b* are formed on the inner wall 14*a* of the cushioning container 16 at equal angular intervals around a center portion of the cushioning container 16 as seen from a plane (FIG. 4A illustrates three projection portions 14*b* formed at intervals of 120 degrees).

Figure 6:
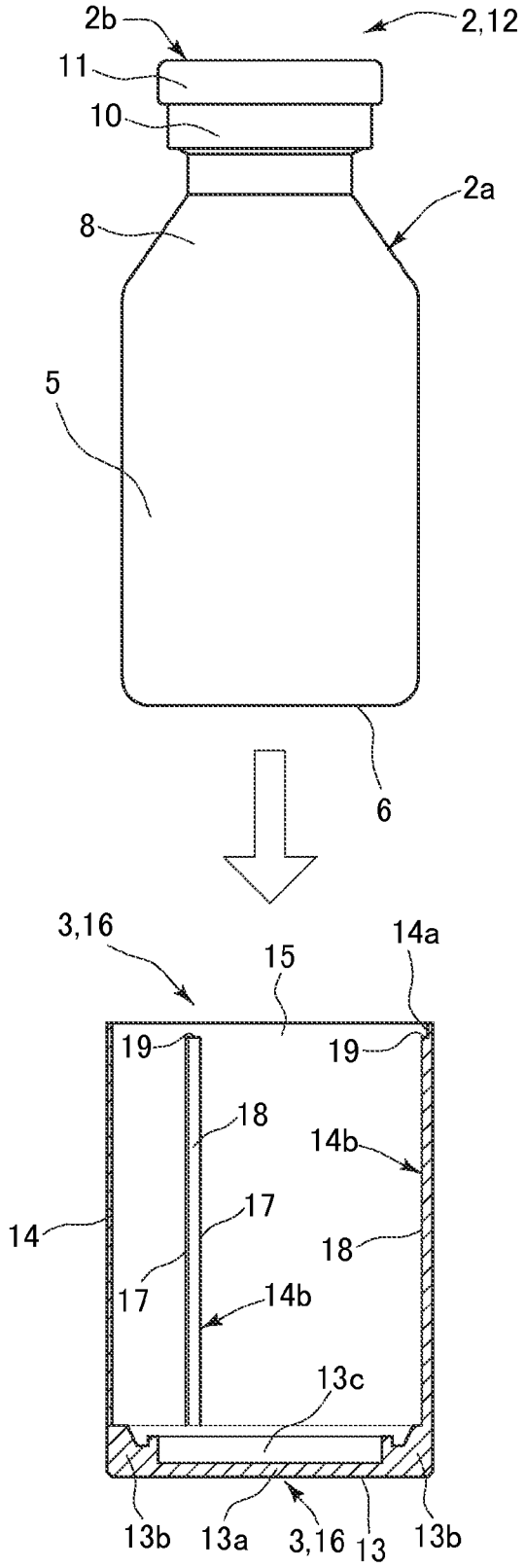
FIG. 6 is a conceptual diagram showing flow of mounting the vial of FIG. 2B to the cushioning container of FIG. 5A.
Figure 7A:
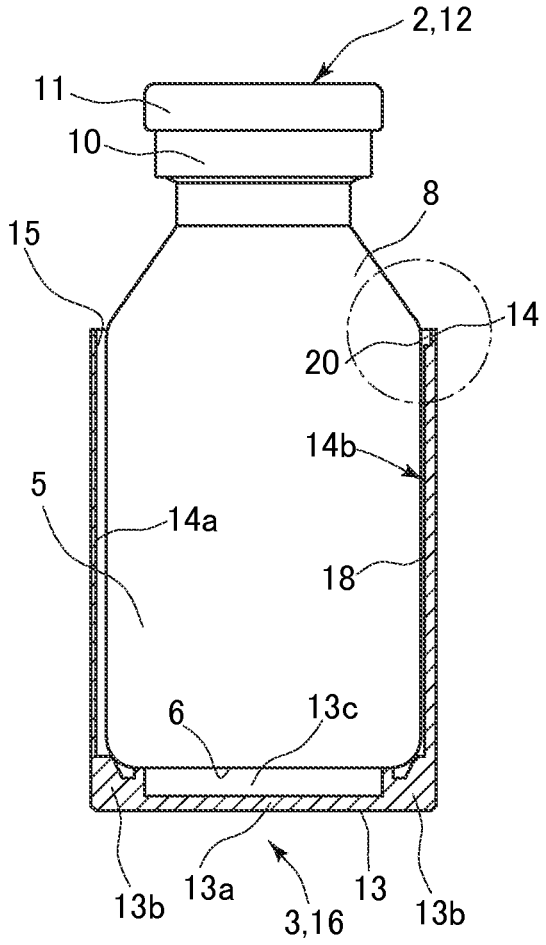
FIG. 7A is a conceptual diagram showing a state where the cushioning container of FIG. 5A is mounted to the vial of FIG. 2B.

Next, a method of mounting the vial 12 to the cushioning container 16 will be described. FIG. 6 and FIG. 7A show an example of mounting the vial 12 into which a drug solution has been injected, to the cushioning container 16. First, with the bottom 6 of the vial 12 being directed downward, the vial 12 is moved toward the opening 15 of the cushioning container 16 that is placed such that the opening 15 faces upward (FIG. 6). Then, the bottom 6 of the vial 12 is inserted into the opening 15 of the cushioning container 16 and butted against the bottom 13 of the cushioning container 16 to obtain a state where the cushioning container 16 is mounted to the vial 12 (FIG. 7A).

Figure 7B:
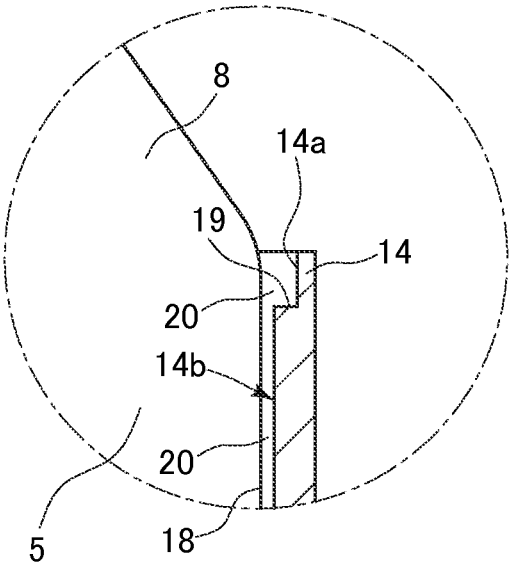
FIG. 7B is a partially enlarged view of FIG. 7A.

In this state, as shown in FIG. 7A, the cushioning container 16 extends from the bottom 6 of the vial 12 over the trunk 5, and the opening 15 of the cushioning container 16 reaches the shoulder 8 of the vial 12 or the vicinity of the shoulder 8. Here, as shown in a partially enlarged view of FIG. 7B, a gap 20 is formed between the trunk 5 of the vial 12 which is located within the cushioning container 16 and the inner wall 14*a* of the cushioning container 16 which is opposed to the trunk 5. Specifically, the gap 20 is formed so as to surround the trunk 5 of the vial 12 and is also formed between each projection portion 14*b* of the cushioning container 16 and the trunk 5 of the vial 12. Similarly, as shown in FIG. 7A, at the bottom 13 of the cushioning container 16, the space 13*c* is formed such that the center portion 13*a* of the bottom 13 is not brought into contact with the bottom 6 of the vial 12.

Figure 8A:
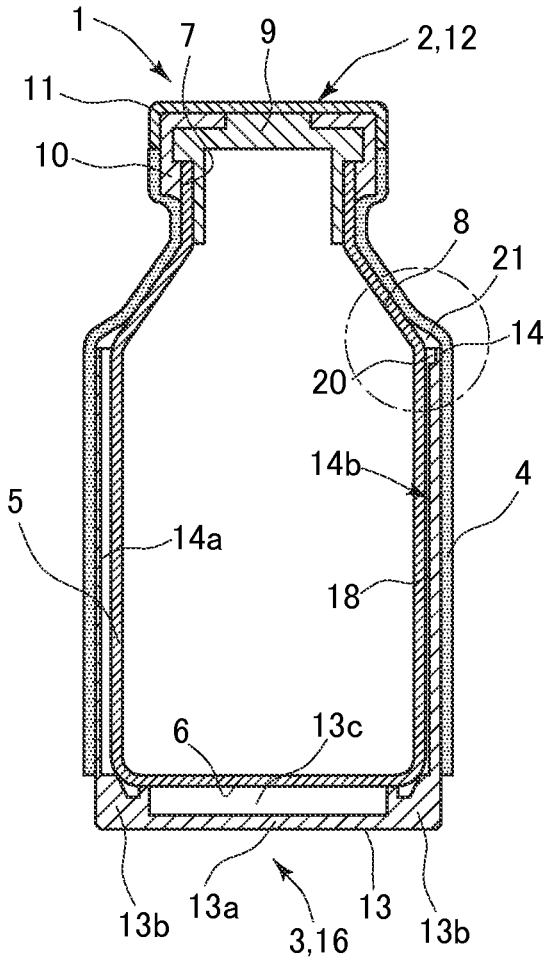
FIG. 8A is a conceptual cross-sectional view showing a state where the vial and the cushioning container of FIG. 7A are integrated and wrapped with a heat-shrinkable film.

In FIG. 8A, in order to integrate the vial 12 and the cushioning container 16 of FIG. 7A, the vial 12 and the cushioning container 16 are covered with the heat-shrinkable film 4, and the side wall 14 of the cushioning container 16 and at least a part of the shoulder 8 of the vial 12 are covered with the heat-shrinkable film 4. Specifically, the heat-shrinkable film 4 extends from the sealing portion 10 of the vial 12 through the shoulder 8 of the vial 12 to the side wall 14 of the cushioning container 16 to wrap a range from the sealing portion of the vial 12 to the side surface of the cushioning container 16. Here, the thickness of the heat-shrinkable film 4 is exaggeratingly drawn for the convenience of explanation, but is actually very small as compared to the thicknesses of the vial 12 and the cushioning container 16.

Figure 8B:
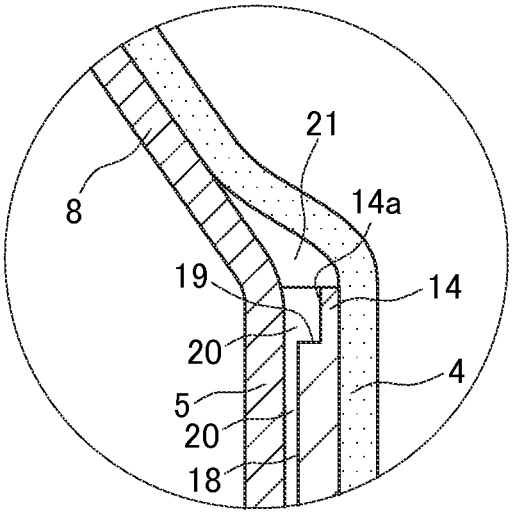
FIG. 8B is a partially enlarged view of FIG. 8A.

FIG. 8B is a partially enlarged view of FIG. 8A. As shown in FIG. 8B, a shoulder space 21 is formed between the shoulder 8 of the vial 12 which is located within the cushioning container 16 and the heat-shrinkable film 4 which is opposed to the shoulder 8. That is, while the gap 20 is ensured, the shoulder space 21 is formed so as to surround a connection portion between the trunk 5 and the shoulder 8 of the vial 12.

When the vial 12 to which the cushioning container 16 has been mounted is wrapped with the heat-shrinkable film 4 as described above, the bottle container 1 is completed. In taking the drug solution, which is injected in the vial 12, out from the bottle container 1, the cap portion 11 of the vial 12 is removed, the tip of the needle of a syringe or the like is stuck into the sealing plug 9 to penetrate the sealing plug 9, and the drug solution is extracted from the inside of the vial 12, whereby it is possible to use the drug solution within the bottle container 1.

As described above, in the bottle container 1, the cushioning container 16 is mounted so as to extend along the trunk 5 and the bottom 6 of the vial 12 as shown in FIG. 8A, and the vial 12 and the cushioning container 16 are integrated by means of the heat-shrinkable film 4, whereby impact on the trunk or the bottom 6 of the vial 12, etc. can be absorbed by the cushioning container 16 to prevent breakage of the vial 12.

Figure 9A:
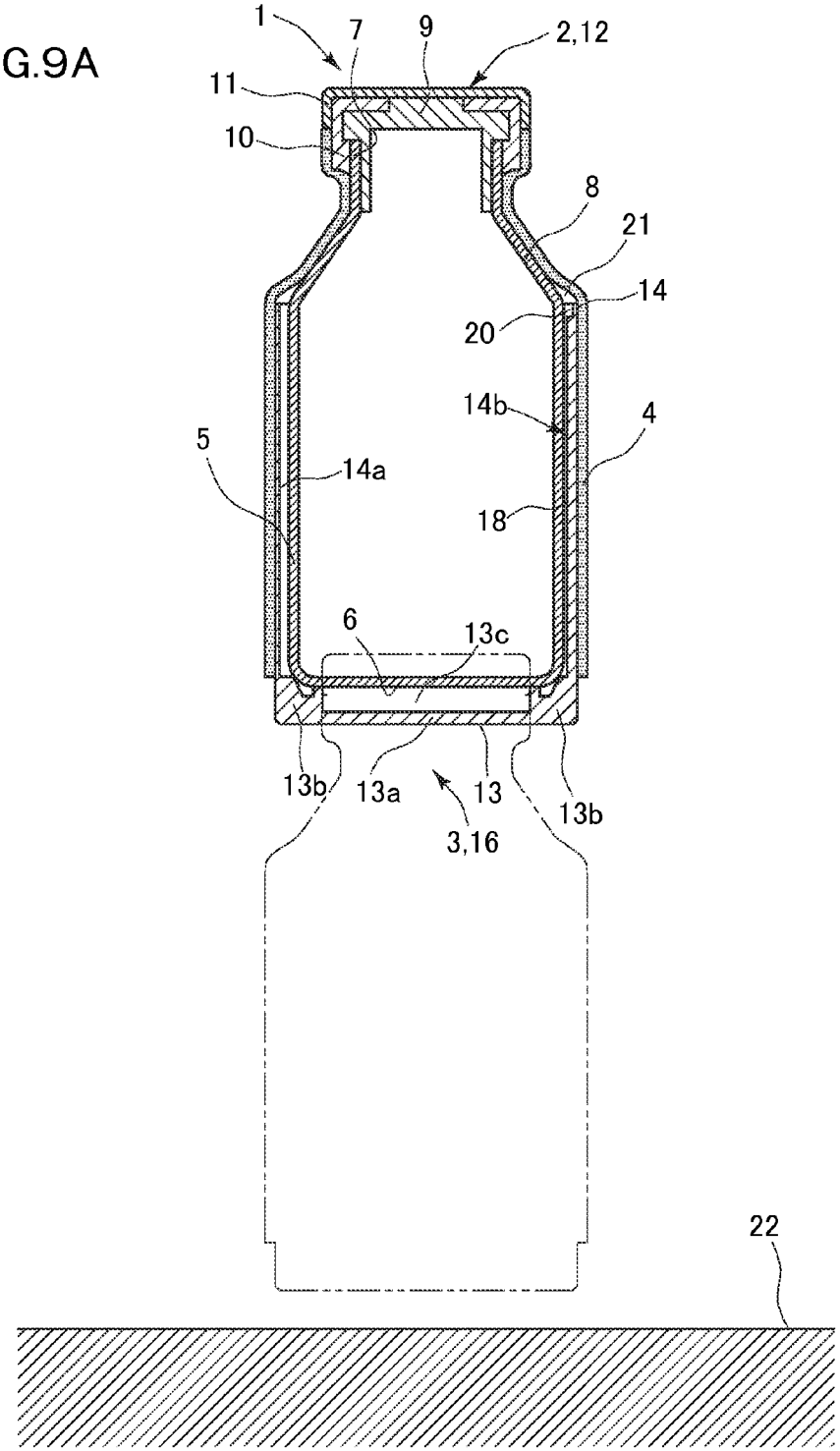
FIG. 9A is a conceptual diagram showing an example where the bottle container drops onto a floor surface.
Figure 9B:
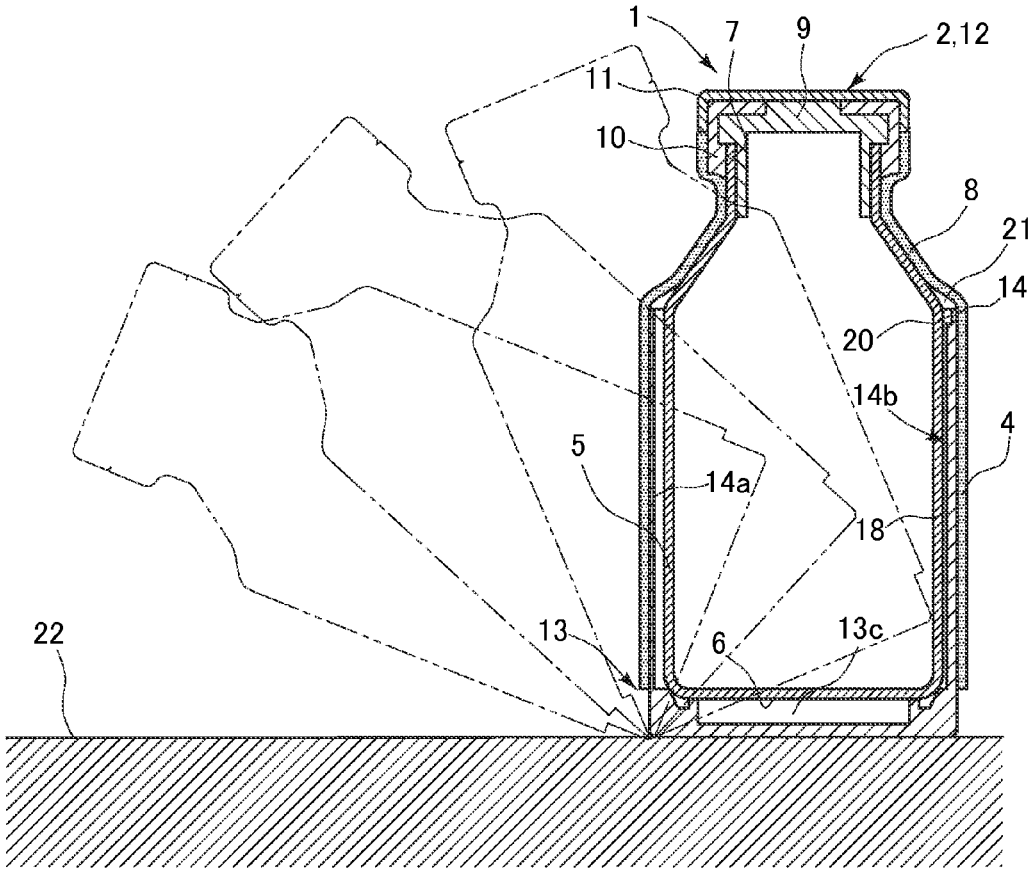
FIG. 9B is a conceptual diagram showing an example where the bottle container placed on the floor surface tips over.

Specifically, as shown in FIG. 7A, the cushioning container 16 extends from the bottom 6 of the vial 12 over the trunk 5, and the opening 15 of the cushioning container 16 reaches the shoulder 8 of the vial 12 or the vicinity of the shoulder 8. Thus, for example, even if the bottle container 1 is slammed at the bottom 13 of the cushioning container 16 against a floor surface 22 as shown in FIG. 9A, the impact can be absorbed by the bottom 13 of the cushioning container 16. Similarly, even if the bottle container 1 placed on the floor surface 22 tips over as shown in FIG. 9B, the impact can be absorbed by the side wall 14 of the cushioning container 16 (even if the bottle container 1 is slammed at the side wall 14 of the cushioning container 16 due to not only tipping over but also drop of the bottle container 1, the impact can be absorbed).

That is, since, at the center portion 13*a* of the bottom 13 of the cushioning container 16, the space 13*c* is formed such that the center portion 13*a* of the bottom 13 is not brought into contact with the bottom 6 of the vial 12 as shown in FIG. 8A, even if the bottom 13 of the cushioning container 16 is slammed against the floor surface 22, the impact is prevented from being transmitted from the center portion 13*a* of the cushioning container 16 directly to the bottom 6 of the vial 12, and the impact on the vial 12 can be cushioned.

Similarly, since the gap 20 is formed between the trunk 5 of the vial 12 and the inner wall 14*a* of the cushioning container 16 which is opposed to the trunk 5 as shown in FIG. 8B, even if the placed bottle container 1 tips over or the bottle container 1 drops with the side wall 14 of the cushioning container 16 being at the lower side, the gap 20 serves as an air cushion in a sense and can cushion the impact transmitted from the inner wall 14*a* of the cushioning container 16 to the vial 12. In addition, since the gap 20 is formed so as to surround the trunk 5 of the vial 12, even if the bottle container 1 tips over in any direction or drops in any direction with the side wall 14 of the cushioning container 16 being at the lower side, the impact can be cushioned.

In wrapping with the heat-shrinkable film 4, due to shrinkage of the heat-shrinkable film 4, an external force is applied to the side wall 14 of the cushioning container 16 and acts so as to narrow the gap 20 between the side wall 14 and the trunk 5 of the vial 12 depending on the material of the cushioning container 16 (when the material of the cushioning container 16 is soft). However, contact between the inner wall 14*a* of the cushioning container 16 and the trunk 5 of the vial 12 is suppressed by each projection portion 14*b* of the cushioning container 16. Each projection portion 14*b* serves as a gap formation assist portion which assists in forming the gap 20, thereby enhancing the air cushion effect of the gap 20. In addition, in addition to the time when the external force is applied by the heat-shrinkable film 4, also when another external force such as external impact is applied, contact between the inner wall 14 of the cushioning container 16 and the trunk 5 of the vial 12 is similarly suppressed. Even when the material of the cushioning container 16 is hard, also if the gap between the side wall 14 and the trunk 5 of the vial 12 is narrowed by some chance, contact between the inner wall 14 of the cushioning container 16 and the trunk of the vial 12 can be suppressed by the projection portions 14*b*. Furthermore, even if the gap 20 is not narrowed, each projection portion 14*b* servers as a rib to increase the rigidity of the cushioning container 16, whereby impact on the vial 12 can be absorbed.

Since each projection portion 14*b* extends to the vicinity of the opening 15 without reaching the opening 15 of the cushioning container 16 as shown in FIG. 5A and FIG. 5B, even if the placed bottle container 1 tips over as shown in FIG. 9B, in particular, even if the bottle container 1 tips over such that the outer wall side thereof corresponding to the inner wall 14*a* of the cushioning container 16 on which the projection portions 14*b* are formed is slammed against the floor surface 22 (or even if the bottle container 1 drops so), a large space can be ensured, as shown in FIG. 8B, as the gap 20 around the opening 15 of the cushioning container 16 on which a large impact force acts, and the air cushion effect can be achieved although the projection portions 14*b* are provided.

Since the projection portions 14*b* are formed so as to extend from the bottom 13 of the cushioning container 16 toward the opening 15 as shown in FIG. 5A and FIG. 5B, contact between the inner wall 14*a* of the cushioning container 16 and the trunk 5 of the vial 12 can be suppressed at least in the vicinity of a region from the bottom 13 of the cushioning container 16 to the opening 13 in which each projection portion 14*b* is formed.

Since the connection surface 18 connecting the outer opposed surfaces 17 of each projection portion 14*b* is a flat surface as shown in FIG. 4A to FIG. 5B, contact with the tubular cushioning container 16 can be effectively suppressed. In addition, since the interval between the outer opposed surfaces 17 is uniform, the gap 20 can be formed substantially uniformly in the up-down direction of the vial 12 and the cushioning container 16, so that a large space can be ensured as the gap 20 between the vicinity of the shoulder 8 of the vial 12 and the opening 15 of the cushioning container 16 by the step 19 of each projection portion 14*b*.

Since the projection portions 14*b* are formed on the inner wall 14*a* of the cushioning container 16, which is formed in a circular shape as seen from above, discontinuously in the circumferential direction as shown in FIG. 4A, the projection portions 14*b* can assist in forming the gap 20 along the circumferential direction of the cushioning container 16. Specifically, since the projection portions 14*b* are formed at equal angular intervals in the circumferential direction around the center portion of the cushioning container 16 as seen from a plane (FIG. 4A) (in FIG. 4A, the three projection portions 14*b* are formed), the projection portions 14*b* can assist in forming the gap 20 uniformly in the circumferential direction of the cushioning container 16, thereby enhancing cushioning performance in the circumferential direction of the cushioning container 16.

Since the side wall 14 including the projection portions 14*b* is formed with the thickness T3 smaller than the thickness T2 of the outer peripheral portion 13*b* of the bottom 13 as shown in FIG. 5A, the center of gravity of the cushioning container 16 becomes low, and the cushioning container 16 becomes stable during time of being placed.

In integrating the cushioning container 16 and the vial 12 by means of the heat-shrinkable film 4, the shoulder space 21 is formed between the shoulder 8 of the vial 12 and the heat-shrinkable film 4 which is opposed to the shoulder 8 as shown in FIG. 8B. Thus, if the placed bottle container 1 tips over as shown in FIG. 9B (or if the bottle container 1 drops so), the shoulder space 21 can protect the surrounding of the opening 15 of the cushioning container 16 on which a large impact force acts. The shoulder space 21, together with the gap 20, enhances the air cushion effect.

Since the heat-shrinkable film 4 wraps the range from the sealing portion 10 of the vial 12 through the shoulder 8 to the side wall 14 of the cushioning container 16, and the cap portion 11 is not covered with the heat-shrinkable film 4 as shown in FIG. 8A, it is possible to use the drug solution within the vial 12 without peeling off the heat-shrinkable film 4. Specifically, the exposed cap portion 11 is removed from the vial 12, and the drug solution can be extracted through the sealing plug 9 by using a syringe or the like. Therefore, even during use of the bottle container 1 in which the risk of drop of the bottle container 1 increases, the bottle container 1 can prevent breakage of the vial 12, since the cushioning container 16 and the vial 12 are integrated.

As shown in FIG. 1 and FIG. 3, the portion of the vial 12 that is not covered with the cushioning container 16 has a tapered shape, the opening portion 7 of the vial 12 is covered with the cap 2*b*, and the portion of the vial 12 that is not covered with the cushioning container 16 and the cap 2*b* has a constricted shape. Thus, even if the bottle container 1 drops, there is a low possibility that the tapered-shaped portion of the vial 12 that is not covered with the cushioning container 16 is slammed directly against the floor surface, and bottle breakage can be efficiently prevented without covering the entire surface of the vial 12.

Figure 10:
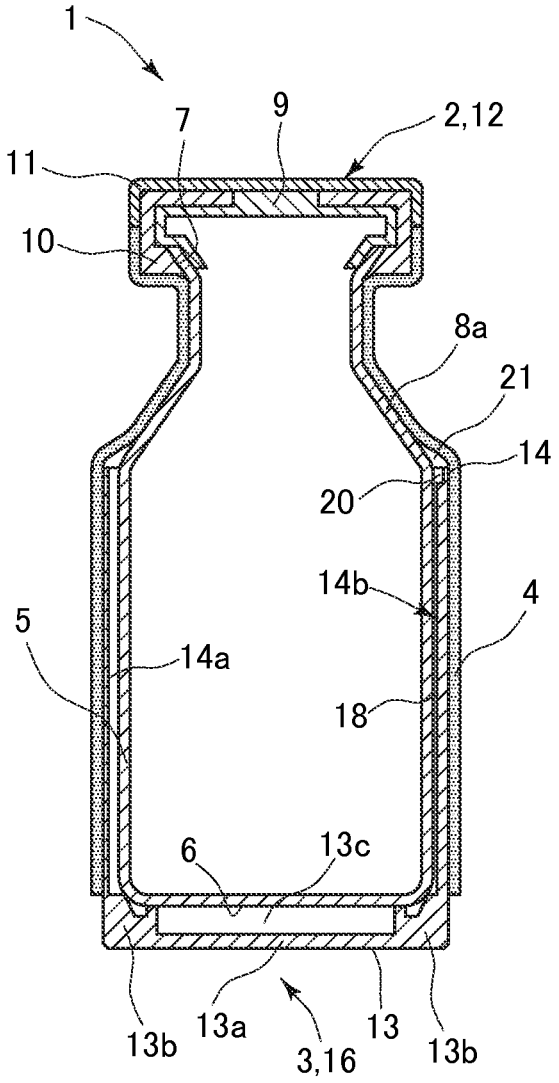
FIG. 10 is a schematic cross-sectional view showing Modification 1 of an inner container constituting a part of the bottle container.

The bottle container 1 having a bottle breakage-preventing function has been described above. Next, a modification of the shoulder 8 of the inner container 2 shown in FIG. 10 will be described. The configuration other than the shoulder 8 is the same as the configuration of the above-described vial 12, and the main difference is the shape of the shoulder 8. FIG. 10 is a cross-sectional view showing Modification 1 of a shoulder 8*a* of the inner container 2. The shoulder 8 having a constricted shape is formed between the trunk 5 and the opening portion 7. Thus, the portion of the vial 12 that is not covered with the cushioning container 16 or the cap 2*b* is formed in a recessed shape in a sense, and hence it is possible to reduce a possibility that impact is applied directly to the constricted-shaped portion of the vial 12 that is not covered with the cushioning container 16.

Figure 11:
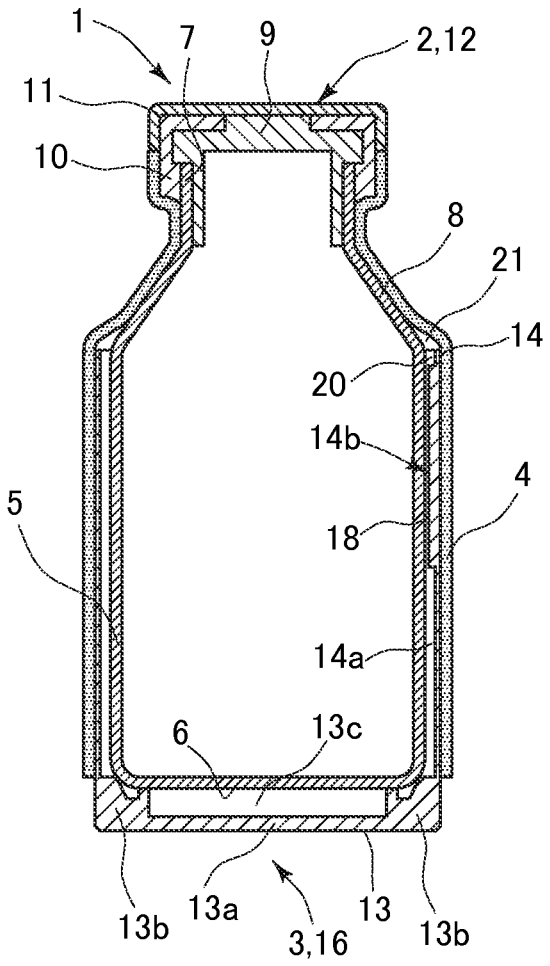
FIG. 11 is a schematic cross-sectional view showing Modification 1 of an outer container constituting a part of the bottle container.
Figure 12:
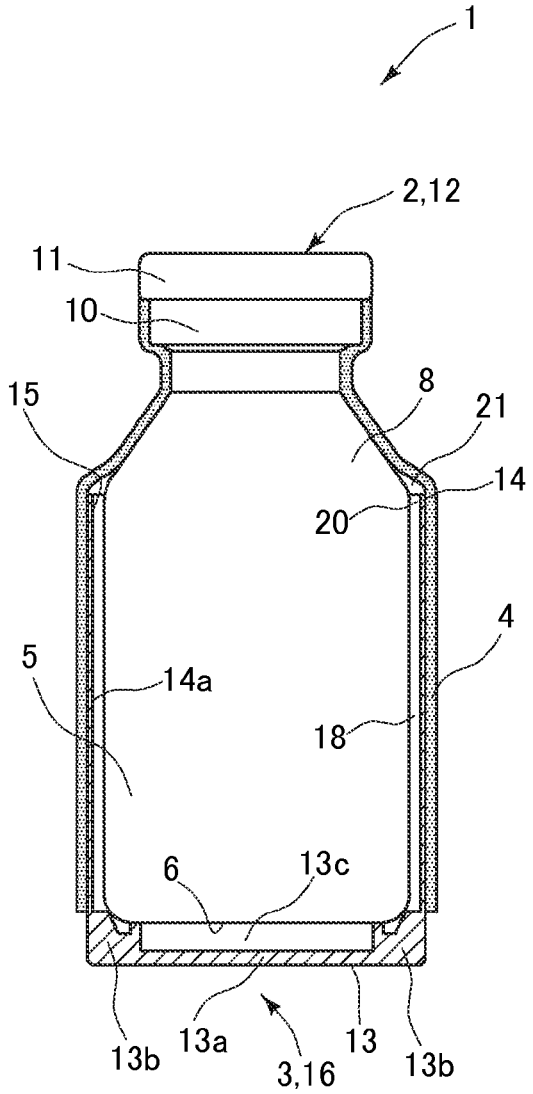
FIG. 12 is a schematic cross-sectional view showing Modification 2 of the outer container constituting a part of the bottle container.

In the above description, each projection portion 14*b* of the cushioning container 16 extends from the lower portion (bottom 13) of the side wall 14 toward the opening 15. However, each projection portion 14*b* may be configured to extend from a middle portion of the side wall 14 toward the opening 15 as shown in FIG. 11. In addition, as shown in FIG. 12, no projection portion may be formed in the bottle container 1. Even when no projection portion is formed, the gap 20 and space 13*c* can suppress transmission of external force to the vial 12.

Figure 13:
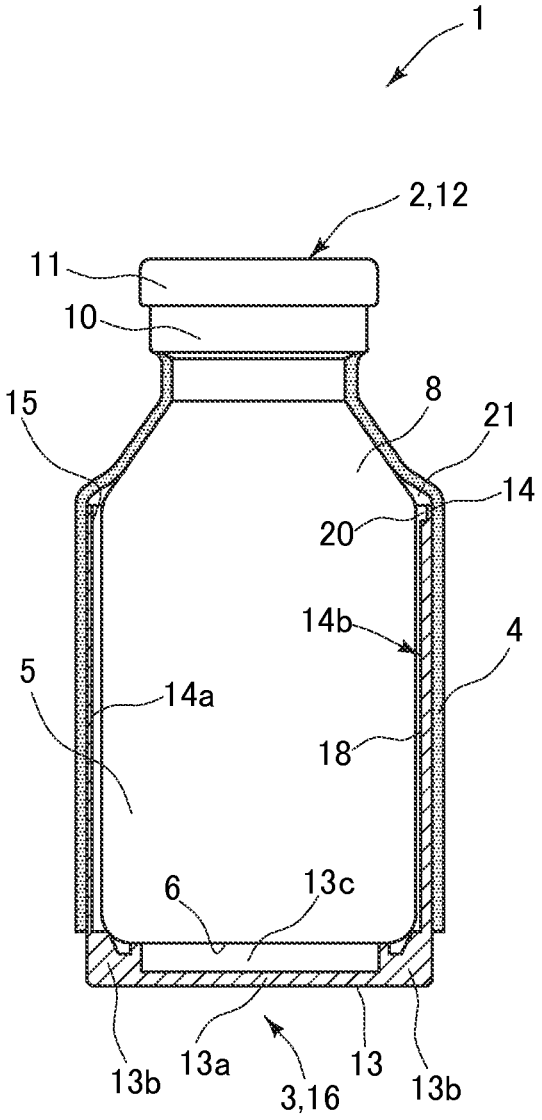
FIG. 13 is a schematic diagram showing Modification 1 of the heat-shrinkable film constituting a part of the bottle container.
Figure 14:
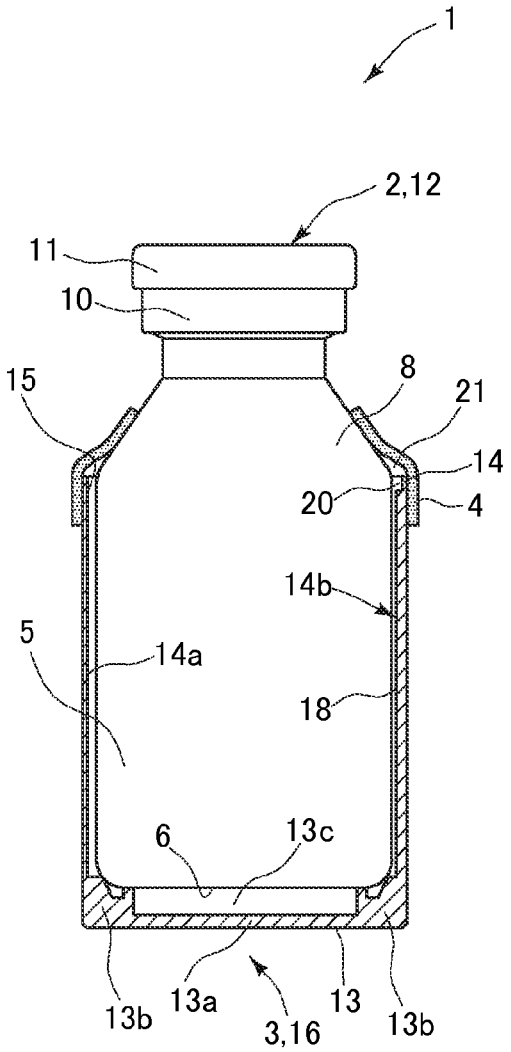
FIG. 14 is a schematic diagram showing Modification 2 of the heat-shrinkable film constituting a part of the bottle container.

In the above description, the heat-shrinkable film 4 wraps the range from the sealing portion 10 of the vial 12 to the side surface of the cushioning container 16. However, the heat-shrinkable film 4 may wrap a range from below the sealing portion 10 of the vial 12 through the shoulder 8 to the side surface of the cushioning container 16 as shown in FIG. 13, or may wrap the connection portion where the shoulder 8 of the vial 12 and the trunk 5 are connected to each other, and the surrounding of the connection portion as shown in FIG. 14. When the connection portion and its surrounding are wrapped, it is possible to reduce the quantity of the heat-shrinkable film 4 to be used.

Figure 15:
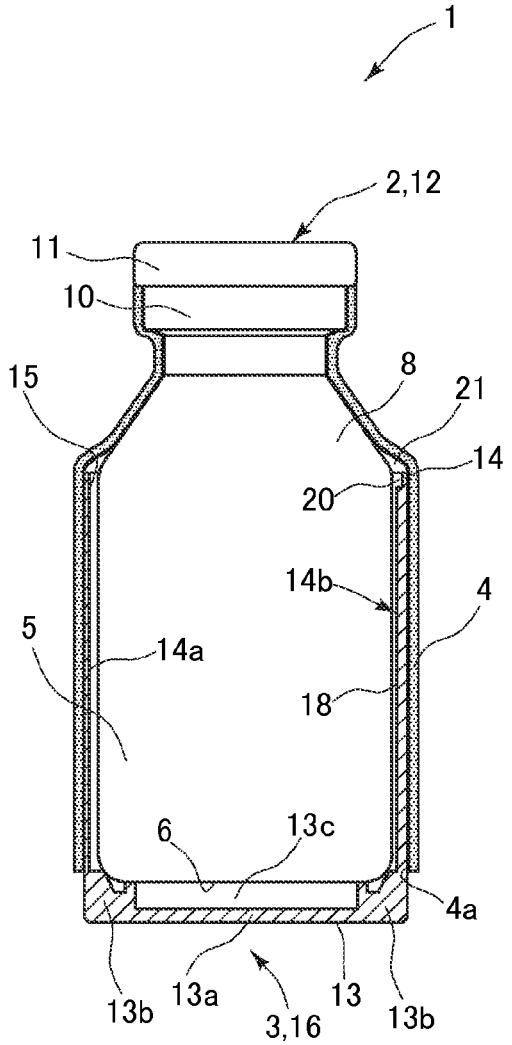
FIG. 15 is a schematic diagram showing Modification 3 of the heat-shrinkable film constituting a part of the bottle container.
Figure 16:
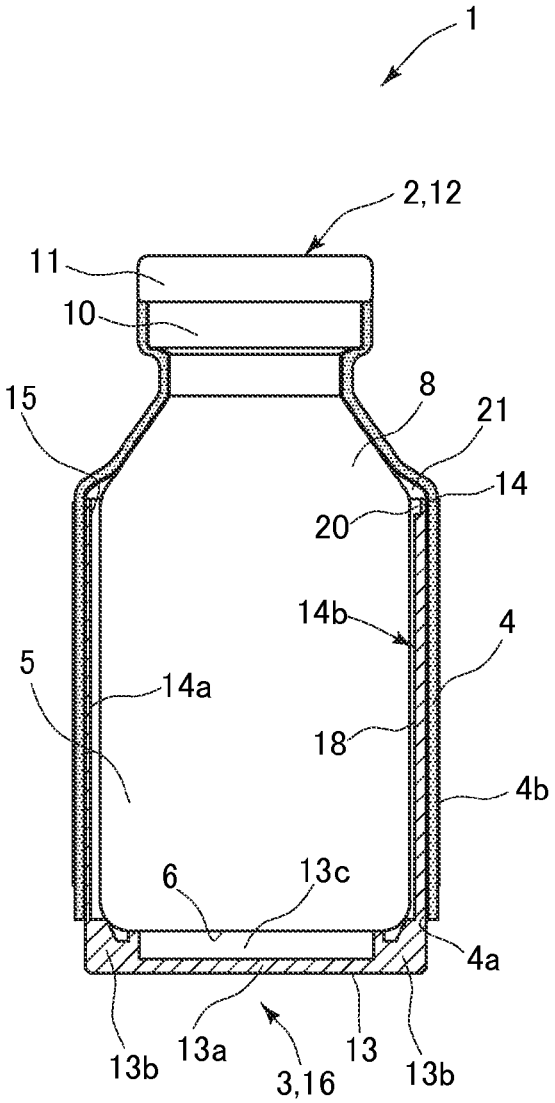
FIG. 16 is a schematic diagram showing Modification 4 of the heat-shrinkable film constituting a part of the bottle container.

As shown in FIG. 15, an adhesive portion 4*a* may be formed on the back surface of the heat-shrinkable film 4. In a state where the vial 12 and the cushioning container 16 adhere to the heat-shrinkable film 4 by means of the adhesive portion 4*a*, the vial 12 and the cushioning container 16 are wrapped. Thus, the gap 20 is sealed, and it is possible to enhance the cushion effect of the gap 20. In addition, as shown in FIG. 16, a printed portion 4*b* may be provided to the heat-shrinkable film 4.

Although the embodiments of The invention have been described above, The invention is not limited to the specific description thereof, and the illustrated configurations and the like can be combined as appropriate within a range where there is no technical contradiction, to practice The invention, or a certain element or process can be substituted with a known form to practice The invention.

DESCRIPTION OF THE REFERENCE CHARACTERS

1 bottle container
2 inner container (vial 12)
3 outer container (cushioning container 16)
4 heat-shrinkable film
5 trunk
6 bottom
7 opening portion
8 shoulder
13 bottom
14 side wall
15 opening
20 gap
21 shoulder space
22 floor surface

The invention claimed is:

1. A bottle container with a bottle breakage-preventing function, the bottle container comprising:

a tubular inner container including a cap at an upper portion thereof, the inner container being formed of an easily-breakable material, wherein the inner container includes a shoulder formed in a constricted shape or a tapered shape at the upper portion; and an outer container mounted so as to extend along a bottom and a trunk towards the shoulder of the inner container such that the shoulder of the inner container is not covered with the outer container, wherein an outer peripheral portion of a bottom of the outer container is made thicker than a trunk of the outer container, and a center portion of the bottom of the outer container is made thinner than the outer peripheral portion to form a space such that the center portion of the bottom of the outer container is not brought into contact with the bottom of the inner container, the outer container mounted to the inner container and at least the shoulder of the inner container are covered with a heat-shrinkable film, whereby the inner container and the outer container are integrated, the outer container is a cushioning container configured to protect the inner container, and in a state where a gap is formed between the trunk of the inner container which is located within the cushioning container and an inner wall of the cushioning container which is opposed to the trunk, the inner container and the cushioning container are wrapped with the heat-shrinkable film, wherein the gap extends beyond an upper portion of the outer container and between the heat-shrinkable film and the shoulder of the inner container.

2. The bottle container according to claim 1, wherein a projection portion is provided on the inner wall of the cushioning container so as to project inward and extend toward an opening of the cushioning container, and the projection portion suppresses contact between the inner wall of the cushioning container and the trunk of the inner container and serves as a gap formation assist portion configured to assist in forming the gap.

3. The bottle container according to claim 2, wherein the projection portion extends to a vicinity of the opening of the cushioning container without reaching the opening.

4. The bottle container according to claim 3, wherein the cushioning container is formed in a circular shape as seen from above, and the projection portion is formed on the inner wall of the cushioning container discontinuously in a circumferential direction.

5. The bottle container according to claim 1, wherein an adhesive portion is formed on a back surface of the heat-shrinkable film, and in a state where the inner container and the outer container adhere to the heat-shrinkable film by means of the adhesive portion, the inner container and the outer container are wrapped with the heat-shrinkable film.

6. The bottle container according to claim 5, wherein in a state where the gap is sealed by means of the adhesive portion, the inner container and the outer container are wrapped with the heat-shrinkable film.

7. The bottle container according to claim 2, wherein an upper end of the projection portion has a step configured to assist in forming the gap, wherein the upper end of the projection portion extends further along the inner wall of the cushioning container than a connection surface, positioned adjacent to the trunk of the inner container, to form the step.

* * * * *